US009748020B2

(12) United States Patent
Oshima et al.

(10) Patent No.: US 9,748,020 B2
(45) Date of Patent: Aug. 29, 2017

(54) FLEX-RESISTANT WIRE AND WIRE HARNESS

(71) Applicant: YAZAKI CORPORATION, Tokyo (JP)

(72) Inventors: Takeshi Oshima, Shizuoka (JP); Yuki Tosaya, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/073,414

(22) Filed: Mar. 17, 2016

(65) Prior Publication Data

US 2016/0293292 A1 Oct. 6, 2016

(30) Foreign Application Priority Data

Apr. 6, 2015 (JP) ..... 2015-077623

(51) Int. Cl.
*H01B 13/02* (2006.01)
*H01B 7/00* (2006.01)

(52) U.S. Cl.
CPC ..... *H01B 7/0009* (2013.01); *H01B 7/0045* (2013.01); *H01B 13/02* (2013.01)

(58) Field of Classification Search
CPC ..... H01B 5/08; H01B 7/04; H01B 7/0045
USPC ..... 174/128.2, 128.1
See application file for complete search history.

(56) References Cited

U.S. PATENT DOCUMENTS 5,760,341 A * 6/1998 Laske ..... H01B 7/0009 174/113 R
5,784,874 A * 7/1998 Bruyneel ..... D07B 1/0613 57/237
6,023,026 A * 2/2000 Funahashi ..... D07B 1/0673 174/128.1
6,920,745 B2 * 7/2005 Bruyneel ..... D07B 1/0666 57/237
7,426,821 B2 * 9/2008 Soenen ..... B23K 1/0008 57/236
7,426,822 B2 * 9/2008 Vancompernolle .. B23K 11/002 57/237
9,322,131 B2 * 4/2016 Chuang ..... D07B 1/10
(Continued)

FOREIGN PATENT DOCUMENTS

JP 2006-283269 * 10/2006
JP 2010-177189 A 8/2010
JP 2011-18545 A 1/2011

*Primary Examiner* — Michael F McAllister
(74) *Attorney, Agent, or Firm* — Kenealy Vaidya LLP

(57) ABSTRACT

A flex-resistant wire has a conductor portion configured as a multiple-stranded wire. The multiple-stranded wire has a plurality of bunched strands that are twisted together. Each of the bunched strands has a plurality of conductors that are twisted together. In each of the bunched strands, the lay length of the conductors that are twisted together is at least 10 times greater than a strand diameter of the bunched strand but not greater than 47.2 times the strand diameter. The lay length of the bunched strands that are twisted together is at least 5 times greater than a pitch diameter of the multiple-stranded wire but not greater than 30 times the pitch diameter. The lay length of the conductors is smaller than or equal to the lay length of the bunched strands. The flex-resistant wire may be provided as one of the wires forming a wire harness.

3 Claims, 2 Drawing Sheets

(56) References Cited

U.S. PATENT DOCUMENTS

| | | | | |
|---|---|---|---|---|
| 2002/0129969 | A1* | 9/2002 | Groegl | H01B 7/041<br>174/128.1 |
| 2010/0189884 | A1 | 7/2010 | Kaiser et al. | |
| 2011/0005805 | A1 | 1/2011 | Eshima | |

* cited by examiner

FLEX-RESISTANT WIRE AND WIRE HARNESS

CROSS-REFERENCE TO RELATED APPLICATIONS

The present application claims priority from Japanese Patent Application No. 2015-077623 filed on Apr. 6, 2015, the entire content of which is incorporated herein by reference.

FIELD OF INVENTION

The present invention relates to a flex-resistant wire and a wire harness.

RELATED ART

In recent years, in automobiles, needs for flex-resistant wires are being increased with the increasing number of components and improving performance. To improve flexibility, a related art cable has thin diameter inclusions interposed between adjoining strands. This cable is increased in flexibility because the friction between the strands is decreased by the thin diameter inclusions and hence disconnection of conductors of each strand is suppressed (see. e.g., JP 2011-018545A). Another related art example is an insulated wire in which a slurry layer is interposed between a conductor and an insulator. This insulated wire can be increased in flexibility because the friction between the conductor and the insulator is decreased by the slurry layer and hence disconnection of conductors of a strand is suppressed (see, e.g., JP 2010-177189A).

However, the related art wires require additional thin diameter inclusions or a slurry layer just for the purpose of increasing the flex-resistance.

SUMMARY

Illustrative aspects of the present invention provide a flex-resistant wire and a wire harness that can be increased in flex-resistance without an additional element.

According to an illustrative aspect of the present invention, a flex-resistant wire has a conductor portion configured as a multiple-stranded wire. The multiple-stranded wire has a plurality of bunched strands that are twisted together. Each of the bunched strands has a plurality of conductors that are twisted together. In each of the bunched strands, the lay length of the conductors that are twisted together is at least 10 times greater than a strand diameter of the bunched strand but not greater than 47.2 times the strand diameter. The lay length of the bunched strands that are twisted together is at least 5 times greater than a pitch diameter of the multiple-stranded wire but not greater than 30 times the pitch diameter. The lay length of the conductors is smaller than or equal to the lay length of the bunched strands. The flex-resistant wire may be provided as one of the wires forming a wire harness.

Other aspects and advantages of the invention will be apparent from the following description, the drawings and the claims.

DETAILED DESCRIPTION

Hereinafter, exemplary embodiments of the present invention will be described in detail with reference to the drawings. However, the following exemplary embodiments do not limit the scope of the claimed invention.

Figure 1:
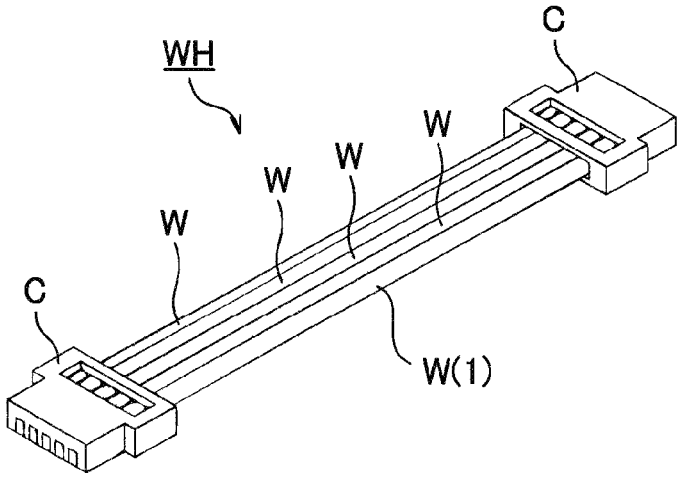
FIG. 1 is a perspective view of an example of a wire harness according to an exemplary embodiment of the present invention.

FIG. 1 is a perspective view of an example wire harness according to the exemplary embodiment of the invention. As shown in FIG. 1, the wire harness WH is a bundle of wires W. At least one of the wires W is a flex-resistant wire 1 which will be described below in detail. For example, as shown in FIG. 1, the wire harness WH may be provided with connectors C at the two ends of the wires W. Alternatively, tapes (not shown) may be wound on their two respective end portions to bundle the wires W. As a further alternative, the wire harness WH may be provided with an exterior component (not shown) such as a corrugated tube.

Figure 2:
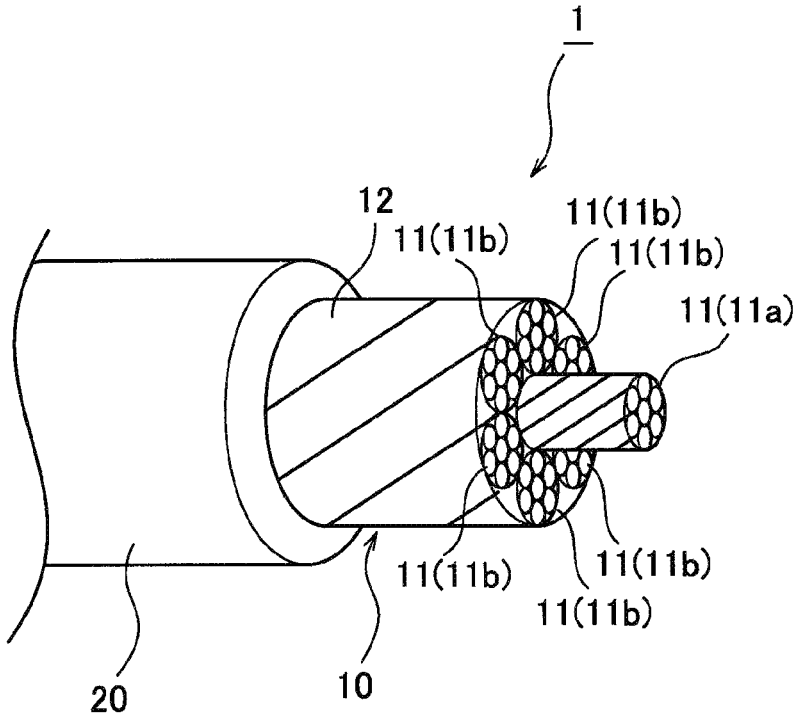
FIG. 2 is a perspective view of a flex-resistant wire shown in FIG. 1.
Figure 3:
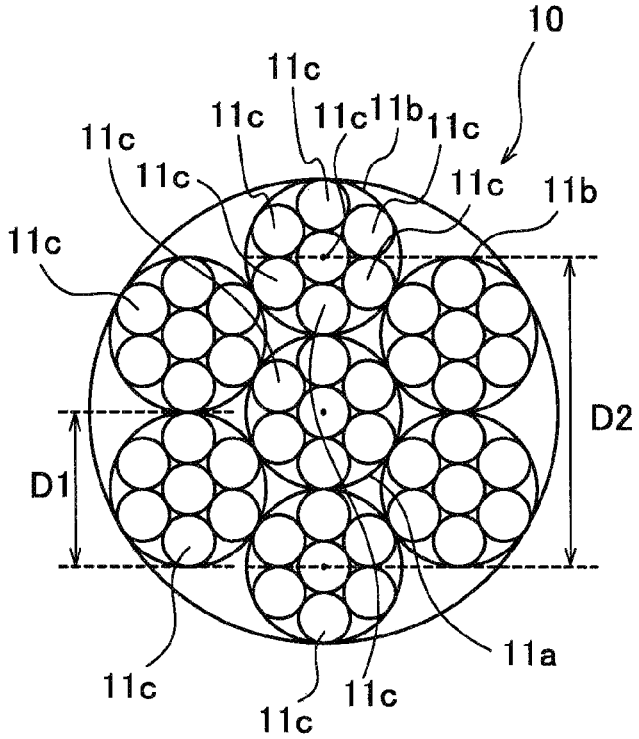
FIG. 3 is a sectional view of a portion of the flex-resistant wire shown in FIG. 1.

FIG. 2 is a perspective view of a flex-resistant wire shown in FIG. 1. FIG. 3 is a sectional view of a portion of the flex-resistant wire shown in FIG. 1. As shown in FIG. 2, the flex-resistant wire 1 is formed by covering, with an insulator 20, a conductor portion 10 which is a multiple-stranded wire 12 formed by twisting together a plurality of bunched strands 11 each of which is formed by twisting a plurality of conductors 11*c* together.

More specifically, the bunched strands 11 consist of a central strand 11*a* and peripheral strands 11*b*. In the exemplary embodiment, a single central strand 11*a* and six peripheral strands 11*b* are used. Each strand 11*a* or 11*b* is formed by twisting, for example, seven conductors 11*c* together. In the exemplary embodiment, the conductors 11*c* are made of pure copper.

In the exemplary embodiment, each bunched strand 11 is configured such that the lay length (length of lay or twist pitch) of the conductors 11*c* is not greater than 47.2 times the strand outer diameter D1. As the lay length decreases, the flex-resistance of each bunched strand 11 increases because the strain that occurs in the conductors 11*c* at the time of bending becomes smaller. Therefore, the flex-resistance of each bunched strand 11 is increased by setting the lay length of the conductors 11*c* to be not greater than 47.2 times the strand outer diameter D1. The multiplication coefficient "47.2" is a value that is suitable for the case that the conductors 11*c* are made of pure copper. That is, this is a value capable of reducing the stress that acts on the conductors 11*c* made of pure copper at the time of bending and thereby preventing a phenomenon that the flex-resistance is lowered due to occurrence of untwisting.

The lay length of the conductors 11*c* of each bunched strand 11 is at least 10 times greater than the strand outer diameter D1. This is because if the lay length smaller than 10 times the strand outer diameter D1, in manufacturing each bunched strand 11 the conductors 11*c* are packed excessively, rendering the bunched strand 11 difficult to manufacture. Furthermore, the cost of each bunched strand 11 is made too high.

As shown in FIG. 3, the strand outer diameter D1 is a value corresponding to the diameter of each bunched strand 11.

In the flex-resistant wire 1 according to the exemplary embodiment, the multiple-stranded wire 12 is formed by using, as the central strand 11*a*, one bunched strand 11 having the above structure and twisting a plurality of peripheral strands 11*b* together such that they are wound around the central strand 11*a*.

In the multiple-stranded wire 12 according to the exemplary embodiment, the lay length of the bunched strands 11 is not greater than 30 times the pitch diameter D2. As the lay length of the bunched strands 11 decreases, the flex-resistance of the multiple-stranded wire 12 increases because the strain that occurs in the conductors 11*c* at the time of bending becomes smaller. Therefore, the flex-resistance of the multiple-stranded wire 12 is increased by setting the lay length of the bunched strands 11 to be not greater than 30 times the pitch diameter D2. The multiplication coefficient "30" is a value that is suitable for the case that the bunched strands 11 each of which is formed using the conductors 11*c* made of pure copper are twisted together. That is, this is a value capable of reducing the stress that acts on the conductors 11*c* of each bunched strand 11 at the time of bending and thereby preventing a phenomenon that the flex-resistance is lowered due to occurrence of untwisting.

The lay length of the bunched strands 11 of the multiple-stranded wire 12 is at least 5 times greater than the pitch diameter D2. This is because if the lay length is smaller than 5 times the pitch diameter D2, in manufacturing the multiple-stranded wire 12 the bunched strands 11 are packed excessively, rendering the multiple-stranded wire 12 difficult to manufacture. Furthermore, the cost of the multiple-stranded wire 12 is made too high.

Since as mentioned above the flex-resistance increases as the lay length of the bunched strands 11 decreases, it might be worth setting the lay length shorter than 5 times the pitch diameter D2. However, in the exemplary embodiment, since the conductors 11*c* are made of pure copper, taking limits of manufacture of that case into consideration, the lay length is set to at least 5 times greater than the pitch diameter D2. Where the conductors 11*c* are made of another metal such as an aluminum alloy, the lay length corresponding to limits of manufacture is 8 times the pitch diameter D2. However, where the conductors 11*c* are made of pure copper as in the exemplary embodiment, the lay length of the bunched strands 11 can be at least 5 times greater than the pitch diameter D2 but smaller than 8 times the pitch diameter D2, whereby the flex-resistance can be made much higher than in the case that the conductors 11*c* are made of any of other metals.

As shown in FIG. 3, the pitch diameter D2 is a value corresponding to the diameter of the center circle of the layer formed by twisting the bunched strands 11 together (i.e., the layer of the peripheral strands 1*b* ), that is, the circle that is formed by the centers of the peripheral strands 11*b*.

As shown in FIG. 2, the lay direction (twisting direction) of the bunched strands 11 and the lay direction of the conductors 11*c* are the same. This is because when each bunched strand 11 comes into contact with another bunched strand 11, conductors 11*c* belonging to them are brought into surface contact with each other. As a result, the conductors 11*c* are less prone to receive local force, which leads to further increase in flex-resistance.

In the flex-resistant wire 1 according to the exemplary embodiment, the lay length of the conductors 11*c* is smaller than or equal to the lay length of the bunched strands 11. More specifically, in the flex-resistant wire 1, the lay length ratio which is the ratio of the lay length of the bunched strands 11 to the lay length of the conductors 11*c* is in a range from 1.00 to 1.52. Since the lay length ratio is at least 1.00, the conductors 11*c* are not tightened excessively, local stress concentration can be prevented when the wire is bent, and lowering of the flex-resistance can be prevented. Furthermore, since the lay length ratio is not greater than 1.52, the conductors are less prone to be untwisted when the wire is bent, which prevents local stress concentration when the wire is bent and prevents lowering of the flex-resistance.

Next, flex-resistant wires according to Examples and Comparative Example will be described. The flex-resistance of each of the flex-resistant wires according to Examples and Comparative Example are shown in Tables 1 and 2 below.

TABLE 1

| | strand diameter D1 (mm) | sub-lay length P1 (mm) | P1/D1 | pitch diameter D2 (mm) | main lay length P2 (mm) |
|---|---|---|---|---|---|
| Ex. 1 | 0.7 | 23 | 32.9 | 1.85 | 30 |
| Ex. 2 | 0.7 | 29 | 41.4 | 1.85 | 40 |
| Ex. 3 | 0.7 | 33 | 47.1 | 1.85 | 50 |
| Ex. 4 | 0.7 | 23 | 32.9 | 1.85 | 37 |
| Comp. Ex. | 0.7 | 23 | 32.9 | 1.85 | 21 |

TABLE 2

| | P2/D2 | lay length ratio P2/P1 | number of times of bending |
|---|---|---|---|
| Ex. 1 | 16.2 | 1.30 | 20000 |
| Ex. 2 | 21.6 | 1.40 | 15000 |
| Ex. 3 | 27 | 1.52 | 10000 |
| Ex. 4 | 20 | 1.61 | 9000 |
| Comp. Ex. | 11.4 | 0.90 | 7500 |

In Examples and Comparative Example, first, each bunched strand was formed by twisting six conductors together such that they are wound around a single, central conductor among seven conductors made of pure copper. The strand outer diameter D1 of each bunched strand was set at 0.7 mm. Seven such bunched strands 11 were prepared, and a multiple-stranded wire was formed by twisting together six bunched strands (peripheral strands) such that were wound around a single, central strand. The pitch diameter D2 of the multiple-stranded wire was set at 1.85 mm.

In Examples and Comparative Example, the lay length of conductors (i.e., sub-lay length P1) and the lay length of bunched strands (i.e., main lay length P2) was set as shown in Table 1.

As for the number of times of bending shown in Table 2, a flex-resistant wire according to each of Examples and Comparative Example was bent repeatedly at normal temperature from a straight state with a bending radius 12.5 mm in an angle range of −90° to 90° using a cylindrical mandrel bend tester and the number of times of bending (i.e., the number of reciprocating motions) at the time of a conductor disconnection was measured. A load of 1200 g was used and the bending speed was set at 0.5 time/s.

In the flex-resistant wire according to Example 1, the sub-lay length P1 was 23 mm and the main lay length P2 was 30 mm. Therefore, the lay length of the conductors was 32.9 times the strand diameter D1 and the lay length of the bunched strands was 16.2 times the pitch diameter D2. The lay length ratio was 1.30.

In the flex-resistant wire according to Example 2, the sub-lay length P1 was 29 mm and the main lay length P2 was 40 mm. Therefore, the lay length of the conductors was 41.4 times the strand diameter D1 and the lay length of the bunched strands was 21.6 times the pitch diameter D2. The lay length ratio was 1.40.

In the flex-resistant wire according to Example 3, the sub-lay length P1 was 33 mm and the main lay length P2 was 50 mm. Therefore, the lay length of the conductors was 47.1 times the strand diameter D1 and the lay length of the bunched strands was 27 times the pitch diameter D2. The lay length ratio was 1.52.

In the flex-resistant wire according to Example 4, the sub-lay length P1 was 23 mm and the main lay length P2 was 37 mm. Therefore, the lay length of the conductors was 32.9 times the strand diameter D1 and the lay length of the bunched strands was 20 times the pitch diameter D2. The lay length ratio was 1.61.

In the flex-resistant wire according to Comparative Example, the sub-lay length P1 was 23 mm and the main lay length P2 was 21 mm. Therefore, the lay length of the conductors was 32.9 times the strand diameter D1 and the lay length of the bunched strands was 11.4 times the pitch diameter D2. The lay length ratio was 0.90.

In the above Examples 1 to 4, the numbers of times of bending were about 20000, 15200, 10000, and 9000, respectively. Thus, the flex-resistant wires according to Examples 1 to 4 each survived 9000 times of bending.

In particular, the flex-resistant wires according to Examples 1 to 3 in which the lay length ratio was in a range from 1.00 to 1.52 each survived 10000 times of bending.

In contrast, in Comparative Example, the numbers of times of bending was 7500. It has been found that the flex-resistant wire according to Comparative Example cannot survive at least 9000 times of bending.

It has been found from the above that it is preferable that the lay length ratio be in the rage from 1.00 to 1.52, and that it is even preferable that the lay length ratio be in a rage from 1.30 to 1.40.

As described above, since the lay length of the conductors 11*c* of each bunched strand 11 is at least 10 times greater than the strand outer diameter D1 but not greater than 47.2 times the strand outer diameter D1, the flex-resistant wire 1 according to the exemplary embodiment can prevent a phenomenon that as in the case that the lay length of the conductors 11*c* is longer than 47.2 times the strand outer diameter D1 strong stress acts on the conductors 11*c* at the time of bending to lower the flex-resistance due to occurrence of untwisting while suppressing a phenomenon that as in the case that the lay length of the conductors 11*c* is shorter than 10 times the strand outer diameter D1 the flex-resistant wire 1 becomes difficult to manufacture and too high in cost.

Furthermore, since the lay length P2 of the bunched strands 11 is at least 5 times graeter than the pitch diameter D2 but not greater than 30 times the pitch diameter D2, the flex-resistant wire 1 according to the exemplary embodiment can prevent a phenomenon that as in the case that the lay length P2 of the bunched strands 11 is longer than 30 times the pitch diameter D2 strong stress acts on the conductors 11*c* of each bunched strand 11 at the time of bending to lower the flex-resistance due to occurrence of untwisting while suppressing a phenomenon that as in the case that the lay length P2 of the bunched strands 11 is shorter than 5 times the pitch diameter D2 the flex-resistant wire 1 becomes difficult to manufacture and too high in cost.

In addition, since the lay length P1 of the conductors 11*c* is smaller than or equal to the lay length P2 of the bunched strands 11, the conductors 11*c* are not tightened excessively, local stress concentration can be prevented when the wire is bent, and lowering of the flex-resistance can be prevented.

Since the flex-resistance is increased by virtue of the proper setting of the lay lengths P1 and P2 of the conductors 11*c* and the bunched strands 11, the flex-resistant wire 1 can be provided that can be increased in flex-resistance without an additional element.

The lay length ratio which is the ratio of the lay length P2 of the bunched strands 11 to the lay length P1 of the conductors 11*c* is in the range from 1.00 to 1.52. Since the lay length ratio at least 1.00, the conductors 11*c* are not tightened excessively, local stress concentration can be prevented when the wire is bent, and lowering of the flex-resistance can be prevented. Since the lay length ratio is not greater than 1.52, the conductors are less prone to be untwisted when the wire is bent, which prevents local stress concentration when the wire is bent and prevents lowering of the flex-resistance.

Since the lay direction of the bunched strands 11 and the lay direction of the conductors 11*c* are the same, when each bunched strand 11 comes into contact with another bunched strand 11, conductors 11*c* belonging to them are brought into surface contact with each other. As a result, the conductors 11*c* are less prone to receive local force, which further lowers the probability of a disconnection and hence leads to increase in flex-resistance.

The wire harness WH according to the exemplary embodiment includes the flex-resistant wire 1. Thus, the wire harness WH can be provided that is superior in flex-resistance and hence is suitable for use in such portions (of slide doors, for example) as to be bent repeatedly.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

For example, while each bunched strand 11 is formed by twisting a plurality of conductors 11*c* together such that they are wound around a single, central conductor 11*c* in the flex-resistant wire 1 of the exemplary embodiment described above, each bunched strand 11 may be formed by twisting a plurality of conductors 11*c* together without using a fixed central conductor 11*c*.

Likewise, while the multiple-stranded wire 12 is formed by twisting a plurality of peripheral strands 11*b* together such that they are wound around a single, central strand 11*a* in the flex-resistant wire 1 of the exemplary embodiment described above, the multiple-stranded wire 12 may be formed by twisting a plurality of peripheral strands 11*b* together without using a fixed central strand 11*a*.

What is claimed is:

1. A flex-resistant wire comprising a conductor portion configured as a multiple-stranded wire, the multiple-stranded wire comprising a plurality of bunched strands that are twisted together, wherein each of the bunched strands comprises a plurality of conductors that are twisted together, wherein, in each of the bunched strands, a lay length of the conductors that are twisted together is at least 10 times greater than a strand diameter of the bunched strand but not greater than 47.2 times the strand diameter, wherein a lay length of the bunched strands that are twisted together is at least 5 times greater than a pitch diameter of the multiple-stranded wire but not greater than 30 times the pitch diameter, and wherein a ratio of the lay length of the bunched strands to the lay length of the conductors is in a range from 1.00 to 1.52.

2. The flex-resistant wire according to claim 1, wherein a lay direction of the bunched strands and a lay direction of the conductors are the same.

3. A wire harness comprising a plurality of wires, at least one of the wires comprising a conductor portion configured as a multiple-stranded wire, the multiple-stranded wire comprising a plurality of bunched strands that are twisted together, wherein each of the bunched strands comprises a plurality of conductors that are twisted together, wherein, in each of the bunched strands, a lay length of the conductors that are twisted together is at least 10 times greater than a strand diameter of the bunched strand but not greater than 47.2 times the strand diameter, wherein a lay length of the bunched strands that are twisted together is at least 5 times greater than a pitch diameter of the multiple-stranded wire but not greater than 30 times the pitch diameter, wherein a ratio of the lay length of the bunched strands to the lay length of the conductors is in a range from 1.00 to 1.52.

* * * * *